US005569168A

United States Patent [19]

Hartwig

[11] Patent Number: 5,569,168

[45] Date of Patent: Oct. 29, 1996

[54] KNEADER MASSAGER HAVING DWELL FEATURE

[75] Inventor: Charles D. Hartwig, Dixon, Ill.

[73] Assignee: Wahl Clipper Corporation, Sterling, Ill.

[21] Appl. No.: 276,557

[22] Filed: Jul. 18, 1994

Related U.S. Application Data

[63] Continuation-in-part of Ser. No. 17,524, Jan. 14, 1994, Pat. No. Des. 356,162.

[51] Int. Cl.[6] ..... A61H 7/00

[52] U.S. Cl. ..... 601/133; 601/103; 601/97

[58] Field of Search ..... 601/133, 134, 601/135, 136, 137, 97, 101, 103, 104, 107, 111

[56] References Cited

U.S. PATENT DOCUMENTS

| | | | |
|---|---|---|---|
| 1,391,919 | 9/1921 | Thompson . | |
| 1,577,751 | 3/1926 | Paschall . | |
| 1,612,899 | 1/1927 | Ahlgren . | |
| 1,617,593 | 2/1927 | Hardy | 601/97 |
| 1,709,170 | 4/1929 | Hassler . | |
| 1,931,849 | 10/1933 | Matson . | |
| 2,038,846 | 4/1936 | Matson . | |
| 2,232,493 | 2/1941 | Stuckey et al. . | |
| 2,706,980 | 4/1955 | Kahn . | |
| 3,499,439 | 3/1970 | Boller . | |
| 3,517,235 | 6/1970 | Flowers et al. . | |
| 3,845,758 | 11/1974 | Anderson . | |
| 3,993,052 | 11/1976 | Miyahara . | |
| 4,469,093 | 9/1984 | Chaplar | 601/103 |
| 4,777,940 | 10/1988 | Yamasaki . | |
| 4,920,957 | 5/1990 | Sutherland . | |
| 5,065,743 | 11/1991 | Sutherland . | |

FOREIGN PATENT DOCUMENTS

| | | |
|---|---|---|
| 385711 | 1/1933 | United Kingdom . |

*Primary Examiner*—Mickey Yu
*Assistant Examiner*—David J. Kenealy
*Attorney, Agent, or Firm*—Greer, Burns & Crain, Ltd.

[57] ABSTRACT

A kneader massager includes a housing having an upper portion and a lower portion, each upper and lower portion partially defining a power transmission chamber having at least one opening. Also included is least one pair of massaging members for massaging the skin of a user, with each such pair of massaging members being mounted in the chamber for reciprocating movement relative to each other, and extending through the at least one opening in the housing. A motor is provided for powering the massaging members and is disposed in the power transmission chamber, and a drive assembly is also disposed in the power transmission chamber for transmitting power from the motor to the massaging members to move each pair of the massaging members between a relaxed position and a pressing position relative to each other. A principal feature of the present invention is the provision of a dwell feature in the drive assembly for periodically prolonging the massaging members in said pressing position. This dwell feature creates a kneading and pressing action which is a closer simulation of manual massage than conventional automatic massaging devices.

17 Claims, 2 Drawing Sheets

KNEADER MASSAGER HAVING DWELL FEATURE

RELATED APPLICATION

This application is a Continuation-In-Part of U.S. Ser. No. 29/017,524, filed Jan. 14, 1994, now U.S. Pat. No. Des. 356,162, and entitled KNEADER MASSAGER.

BACKGROUND OF THE INVENTION

The present invention relates to motor operated massaging devices, and specifically to a massaging device designed to perform a kneading massaging action which simulates manual massaging.

Manual massages normally include a kneading action of the hands, where the massaged flesh or scalp is grasped and squeezed or pinched between the fingers and thumb of the masseuse. The repeated grasping and releasing of massaged flesh contributes to the relaxing benefits of massage.

In an attempt to simulate the action of the human hand, conventional automatic or motor-powered massaging devices typically employ a plurality of finger-like members which either vibrate or rotate to effect massaging action. Conventional rotary massage devices are incapable of performing a kneading operation and are thus somewhat deficient in simulating manual kneading massaging.

At least one device has addressed this problem by providing kneading action, whereby multiple pairs of opposing fingers are reciprocally movable relative to each other. This device employs a single motor which drives the pairs of fingers. A cam and cam follower transmission system is used to transmit the power from the motor to the massage finger members. A drawback of this system is that although the fingers trace a kneading path, the pressure exerted by the fingers is insufficient for simulating manual kneading massage techniques. This drawback is due in part to the relatively low-powered electric motors which are used in such devices. However, the devices are preferably designed to be hand-held, and as such the motor must not be overly large and/or heavy to preclude convenient use by all types of users, including the elderly, women and children.

Thus, there is a need for a motor-powered massaging device which simulates the kneading massaging action of the human hand.

Therefore, a principal object of the present invention is to provide a hand-held, motor-powered massaging device which simulates the kneading action of a human hand while massaging.

Another object of the present invention is to provide a motorized massaging device which exerts a prolonged kneading action, while not using an overly large motor.

Yet another object of the present invention is to provide a hand-held motorized massaging device which effects a kneading action in which massaged flesh is grasped and held for a somewhat prolonged interval.

SUMMARY OF THE INVENTION

The above-listed objects are met or exceeded by the provision of a motorized kneader massager whereby a plurality of pairs of massaging fingers extend from a housing. Each pair of massaging fingers includes first and second members which move reciprocally relative to each other on a cyclical basis between a relaxed or separated position and a pressing or gripping position. The transmission system of the present device is configured so that during each reciprocating cycle, the massaging fingers are held in the grasping or pressing position for a somewhat extended or prolonged interval. This interval is preferably achieved through the use of a cam and cam follower drive system wherein the cam has a dwell feature.

More specifically, the present invention provides a kneader massager, including a housing having an upper portion and a lower portion, each upper and lower portion defining a power transmission chamber having at least one opening. Also included is at least one pair of massaging members for massaging the skin of a user, with each such pair of massaging members being mounted in the chamber for reciprocating movement relative to each other, and extending through the at least one opening in the housing.

A motor is provided for powering the massaging members and is disposed in the power transmission chamber. A drive assembly is also disposed in the power transmission chamber for transmitting power from the motor to the massaging members to move each pair of the massaging members between a relaxed position and a pressing position relative to each other. A principal feature of the present invention is the provision of a dwell feature in the drive assembly for periodically prolonging the massaging members in said pressing position. This dwell feature creates a kneading and pressing action which is a closer simulation of manual massage than conventional automatic massaging devices.

In another embodiment, a kneader massager is provided, including a housing having upper portion and lower portions, each portion defining a power transmission chamber having at least one opening, the housing also including a head portion and a stem portion. At least one pair of massaging members for massaging the skin of a user is mounted in the chamber at the head portion for reciprocating movement relative to each other, and extending through the at least one opening to engage the user's skin.

A motor is provided for powering the massaging members, is disposed in the power transmission chamber and principally located in the stem portion. The motor includes a drive shaft with a worm gear. A drive assembly is disposed in the power transmission chamber at the head portion for transmitting power from the motor to the massaging members to move each pair of the massaging members between a relaxed position and a pressing position. The drive assembly further includes a pair of helical toothed gears, each such gears disposed in the transmission chamber on a corresponding side of the worm gear, and being associated with a corresponding member of each of member of each pair of massaging members.

DESCRIPTION OF THE PREFERRED EMBODIMENT

Figure 2:
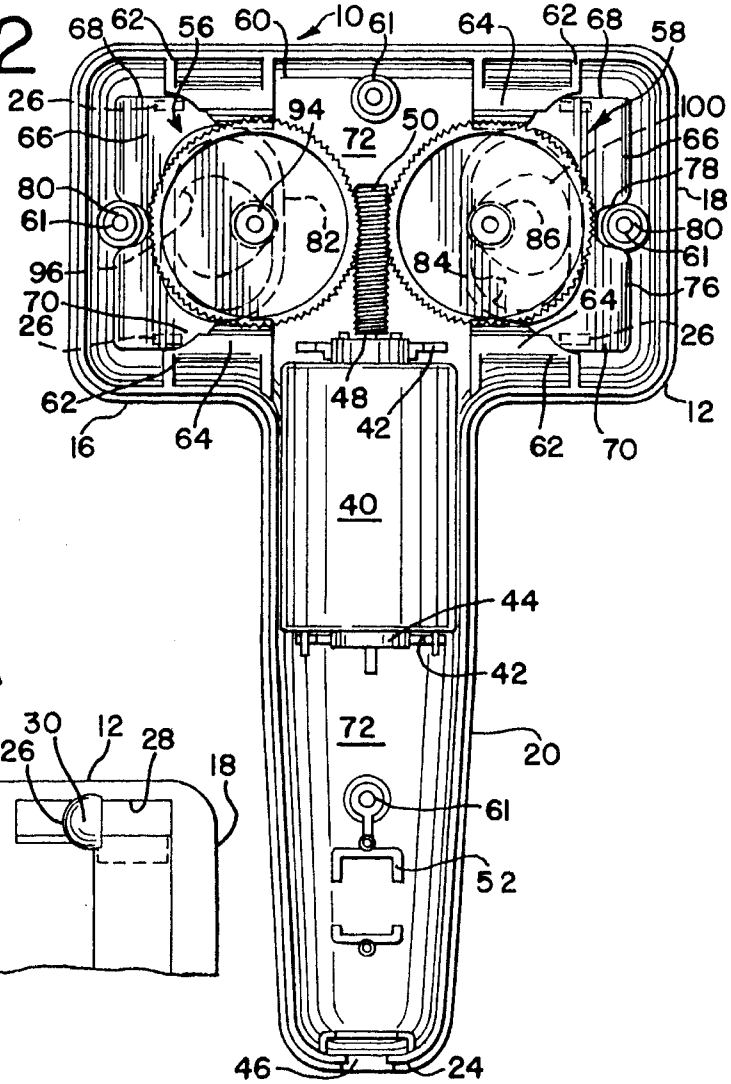
FIG. 2 is an overhead plan view of the kneader massager of FIG. 1, with portions omitted for clarity.
Figure 1A:
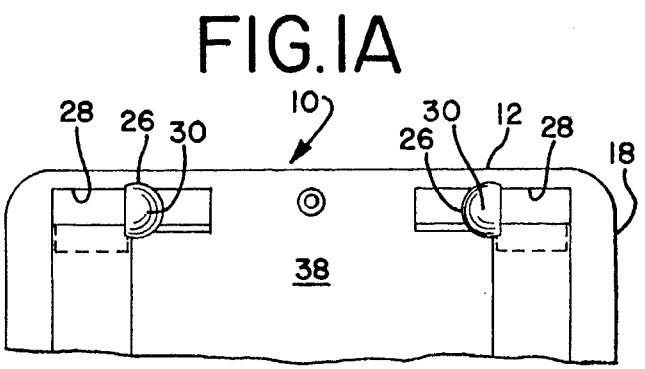
FIG. 1A is a fragmentary bottom plan view of the massager of FIG. 1, with portions omitted for clarity.
Figure 1:
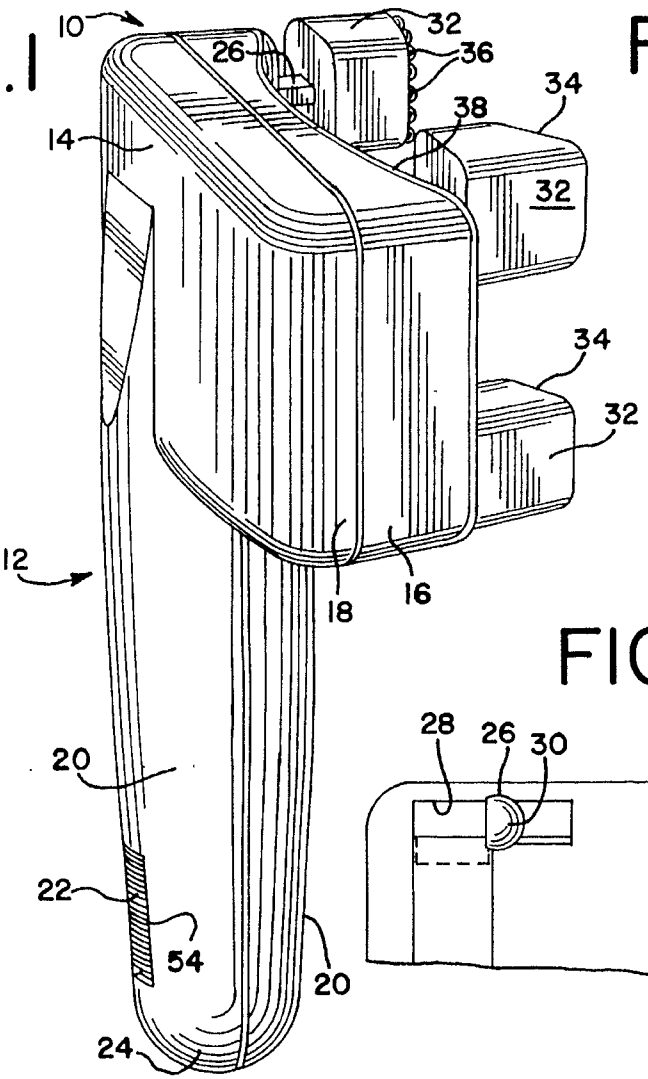
FIG. 1 is a perspective elevational view of the present kneader massager.

Referring now to the drawings, FIGS. 1, 1A and 2 depict a kneader massager which is suitable for use with the present invention. The massager, generally designated 10, includes a housing 12 having an upper portion 14 and a lower portion 16. The housing 12 is preferably made of a durable, impact-resistant plastic material which is suitable for injection molding. FIG. 2 depicts the massager 10 of FIG. 1 with the upper portion 14 removed to expose the working components. Each of the upper and lower portions 14, 16 include a generally rectangular-shaped head area 18 and a generally cylindrical stem or handle area 20. A switch 22 is located on the handle area 20 preferably near a lower end 24, and in the depicted embodiment is located on the upper portion 14.

At the head area 18, a plurality of massaging projections or fingers 26 project from corresponding openings 28 in the lower portion 16. It is contemplated that the massager 10 is provided with at least one and preferably two pairs of opposing fingers 26. Each finger 26 projects from a corresponding opening 28 and is provided with an enlarged or bulbous end 30, to which is releasably secured a resilient pad or foot 32. In the preferred embodiment, the feet 32 are generally cube-shaped, and include a curved contact surface 34 having a plurality of resilient projections or teats 36 which facilitate the gripping or pressing of skin to be massaged. It is contemplated that the contact surfaces 34 may be otherwise toughened to provide positive gripping. The rounded configuration of the bulbous end 30 of each finger 26 enables the feet 32 to pivot about the fingers.

Referring now to FIG. 1, a lower surface 38 of the lower portion 16 has a generally concave shape which increases the reach of the fingers 26. In this manner, the massager 10 may readily access more areas of the body.

Referring now to FIG. 2, the internal structure of the massager 10 is depicted. A motor 40, which in the preferred embodiment is an AC electric motor, is cradled within the housing 12 to be substantially contained within the handle area 20. It is contemplated that equivalent battery-powered motors may also be employed in the massager 10.

In the preferred embodiment, the motor 40 is secured within the housing by motor supports 42 which are integrally molded with the housing. Fore and aft motor supports 42 are provided to interior surfaces of both the upper and lower portions 14, 16. The motor 40 is thus supported at each end. A rear or power supply end 44 of the motor 40 is connected to a suitable power cord (not shown), which passes through a cord aperture 46. Opposite the power supply end 44 of the motor 40, a gear end 48 is provided with an elongate worm gear 50 which is affixed to the motor driveshaft.

Between the power end 44 and the cord aperture 46 on the lower portion 16 is located a switch mounting socket 52. This socket accommodates the switch 22, which is accessible through an opening 54 (best seen in FIG. 1) in the upper portion 14.

Referring again to FIG. 2, at the head area 18, there is found a left finger drive assembly, generally designated 56, and a right finger drive assembly, generally designated 58. In that the finger assemblies 56, 58 are substantially identical to each other, only one will be described in detail. The finger drive assemblies 56, 58, the motor 40 and the switch 22 are disposed in an interior area of the housing 12 which is generally designated the power transmission chamber 60. Both the upper and lower portions 14, 16 of the housing combine to define the chamber 60. The upper and lower portions 14, 16 are secured together by fasteners (not shown) passing through integral bosses 61.

A pair of track guides 62 are preferably molded into the lower portion 16, and assist in securing each finger drive assembly 56, 58 to the lower portion. Each track guide 62 projects normally relative to the lower surface 38 and includes a lip 64 extending normally from the track guide 62. A finger base 66 is a generally flat piece of plastic which is provided with one of the fingers 26 at each of two ends 68, 70. One of the fingers 26 projects normally from each end 68, 70 and passes through a corresponding one of the openings 28 to extend out the lower portion 16. There is preferably a single finger base 66 for each of the finger drive assemblies 56, 58. Each finger base 66 is slidably retained between the track guides 62 for reciprocal movement transverse to the longitudinal axis of the handle area 20.

To prevent the finger bases 66 from bottoming out on an inner surface 72 of the lower portion 16, each finger drive assembly 56, 58 is provided with a pair of track tabs 74 (shown hidden in FIGS. 3–9) which, like the track guides 62, project vertically from the inner surface 72. Each track tab 74 has a longitudinal axis which parallels the track guide 62. In the preferred embodiment, the track tab 74 is approximately as long as the track guide 62.

A first side 76 of the finger base 66 is provided with a notch 78 dimensioned to engage a corresponding mounting boss 80 which projects from the surface 72, and which is one of the mounting bosses 61 discussed above. Opposite the first side 76, a second side 82 of the finger base 66 is provided with an elongate, generally oval-shaped cam follower loop 84. A longitudinal axis of the loop 84 is parallel to the longitudinal axis of the handle area 20. The loop 84 is disposed on the finger base 66 so that it is located over a gear axle boss 86 (shown hidden in FIG. 2) which is integrally joined to the surface 72. In the preferred embodiment, the two gear bosses 86 are located on a line passing through the two mounting bosses 80 and transverse to the longitudinal axis of the handle area 20.

Each finger drive assembly 56, 58 also includes a helical gear and cam assembly, generally designated 88. The assembly 88 includes a helical toothed gear 90, a gear axle 92, which passes through a central hub 94 and is engaged in the gear axle boss 84, and a cam 96. In the preferred embodiment, the helical teeth of the gear 90 are pitched at approximately 3 degrees, although other gear configurations are contemplated. The cam 96 depends from an underside of the gear 90 facing the inner surface 72, and is mounted in an offset position relative to the axle 92 to provide eccentric motion when the axle rotates. In addition, the cam 96 is dimensioned to have a sufficient thickness, and disposed on the gear 90, to engage the cam follower loop 84.

Referring now to FIGS. 2–9, a major feature of the present massage device 10 is that when the cam 96 is configured to have a flat spot or dwell 98, the reciprocating action of the finger bases 66, when driven by the motor 40 through the worm gear 50, creates a pause in the reciprocation of the finger bases, and results in a relatively prolonged pressing or gripping action by the fingers 26. In the preferred embodiment, the flat spot or dwell 98 is disposed between two curved lobes 100, making the cam generally teardrop-shaped.

FIGS. 3–9 depict the rotation of the cam 96 from 0 to 180 degrees rotation. At 0 degrees rotation (best seen in FIG. 3), the finger base 66 is at the limit of its movement away from the corresponding finger base 66 of the opposite finger drive assembly, either 56 or 58. The flat spot 98 is bottomed against a long side of the cam follower loop 84. Thus, the fingers 26 of the corresponding bases 66 will be at their most divergent position.

Figure 4:
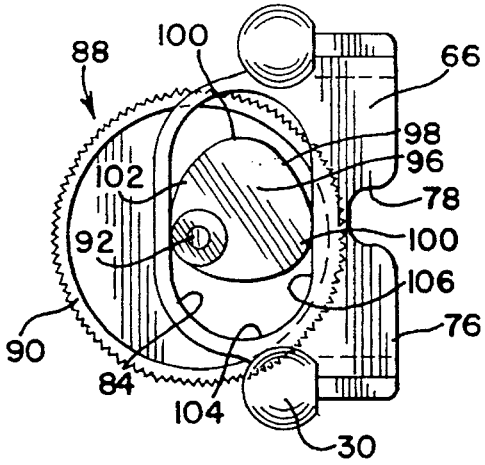

Referring now to FIG. 4, the gear assembly 88, including the axle 92, the gear 90 and the cam 96 have rotated counterclockwise approximately 30 degrees. It will be seen that one of the curved lobes 100 has engaged the cam follower loop 84, which causes the finger base 66 and the corresponding fingers 26 to move toward the left in the drawing, which brings the fingers of opposite drive assemblies closer together.

Figure 3:
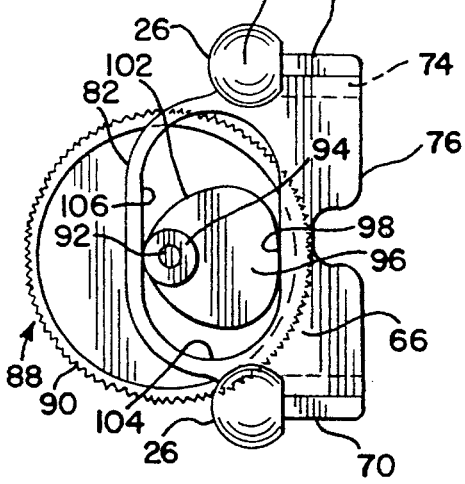
FIGS. 3–9 are sequential fragmentary bottom plan views of the present kneader massager depicted in FIG. 1, illustrating the operation of the present dwell feature.
Figure 5:
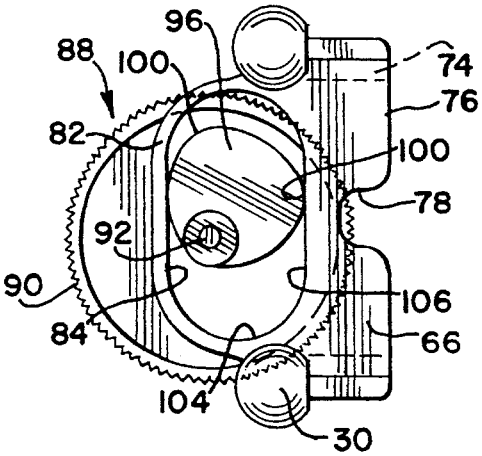

Referring now to FIG. 5, the gear assembly 88 has rotated counterclockwise in the range of an additional 30 degrees, or approximately 60 degrees from the position indicated in FIG. 3. A front edge 102 of the cam 96 engages the cam follower loop 84, causing the fingers 26 to move closer to the corresponding pair of fingers. The curvature of the edge 102 is dimensioned to cause gradual linear movement of the fingers 26 toward each other during this portion of the cycle. It should be noted that the cam 96 does not engage curved end portions 104 of the cam follower loop 84, but basically engages the substantially parallel long edges 106.

Figure 6:
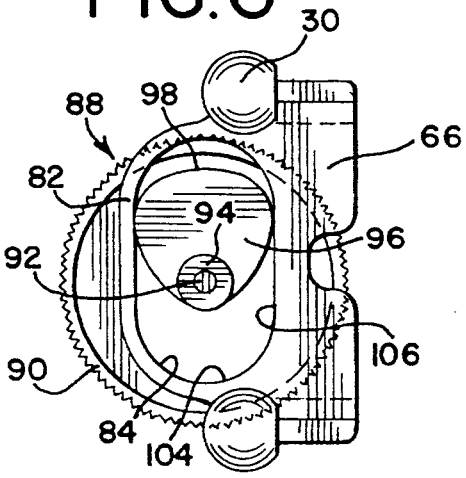
Figure 7:
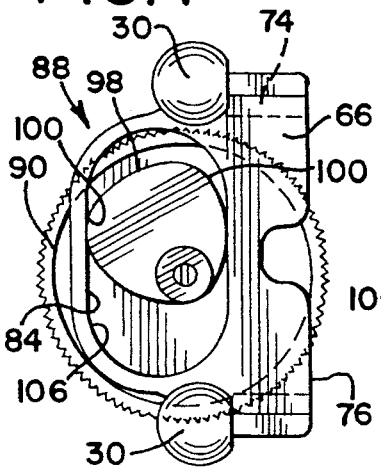
Figure 8:
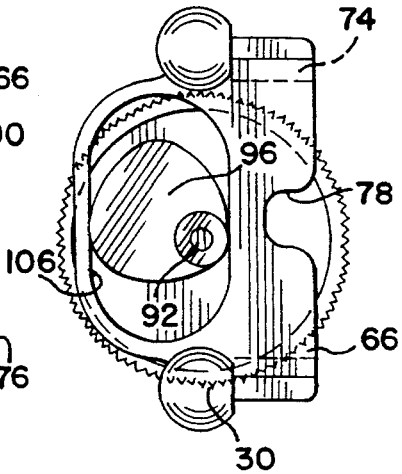

Referring now to FIG. 6, the cam 96 is shown at approximately 90 degrees of displacement from the starting position of FIG. 3, and the engagement of the cam 96 against the edge 106 is such that the lobe 100 still has 60 degrees of rotation prior to it reaching its apex, which signifies the limit of the travel of the fingers 26 toward each other (best seen in FIG. 8) . This apex position, depicted in FIG. 8, is at approximately 170 degrees of displacement from the starting position of FIG. 3. FIG. 7 depicts an interim position in the rotational cycle between FIGS. 6 and 8.

Referring now to FIG. 8, the cam 96 has rotated so that the dwell or flat spot 98 is engaging the edge 106. The flattened configuration of the dwell 98 restrains the fingers 26 from moving toward each other. However, since the motor 40 rotates the worm gear 50 at a constant velocity whether or not the cam 96 is in the dwell portion of the cycle, the torque exerted by the motor 40 through the worm gear 50 and the helical gears 90 exerts a gripping tension on any flesh held between the fingers 26 during the dwell period.

Figure 9:
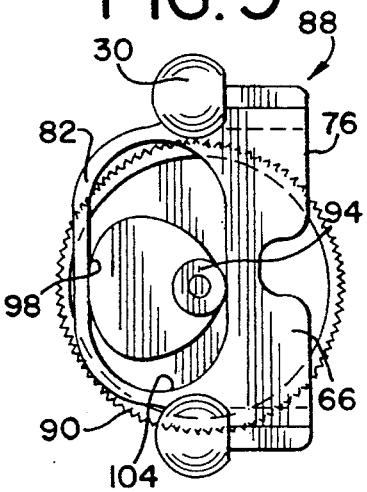

Lastly, referring now to FIG. 9, it will be seen that continual counterclockwise rotation of the cam 96 in the dwell portion of the cycle has not caused any change in the relative position of the finger base 66 relative to the gear 90 from the position shown in FIG. 8. A comparison of FIGS. 8 and 9 provides graphic representation of the gripping or grasping force exerted by the fingers 26 during the dwell portion of the rotational cycle of the cam 96.

It will be appreciated that FIGS. 3–9 depict only half of a rotational cycle of the cam 96, and that the remainder of the cycle would retract the fingers 26 and the finger bases 66 away from each other. Once the fingers 26 reach their maximum separation, there is a corresponding dwell period virtually identical to that described in relation to FIGS. 8 and 9, except that the cam 96 engages the opposite edge 106. It will also be seen from FIGS. 3–9 that the cam 96 always engages both edges 106. This relationship has been found to prevent unwanted movement or play in the fingers throughout the total range of movement.

In the preferred embodiment, the cam 96 is configured so that the dwell 98 prevents linear movement of the fingers 26 for a total of approximately 40 degrees of rotation. However, depending on the application, other dwell periods are contemplated, and may be achieved merely by reconfiguring the cam 96 in ways readily known to skilled practitioners.

Referring again to FIG. 2, another feature of the present kneader massager 10 is that the motor 40, the heaviest component by far, is located approximately centrally in the housing 12. This location causes the device 10 to be well balanced and easy to manipulate. Further, the central location of the single worm gear 50 between the two helical gears 90 provides a simple and trouble free drive mechanism, for both finger bases 66 are driven from the same worm gear. The entire massager 10 includes only five moving parts: the motor 40, the two finger bases 66, and the two combined gear 90 axle 92 and cam 96 assemblies.

Thus, a significant feature of the present kneader massager is that the fingers of the device periodically pause in their reciprocating action to cause a cyclically prolonged pressing or gripping action upon massaged flesh. In this manner, the present massager simulates the action of manual massage, while not requiring corresponding levels of exertion. Due to the configuration of the cam 96, the fingers 26 also periodically pause in the separated or relaxed position. In addition, the arrangement of the motor 40 within the housing 12, and specifically between the two gears 90, enables the massager 10 to be well-balanced and easy to manipulate.

While a particular embodiment of the kneader massager apparatus of the invention has been shown and described, it will be appreciated by those skilled in the art that changes and modifications may be made thereto without departing from the invention in its broader aspects and as set forth in the following claims.

What is claimed is:

1. A kneader massager, comprising:

a housing having an upper portion and a lower portion, each said upper and lower portions defining a power transmission chamber having at least one opening;

at least one pair of massaging means for massaging the skin of a user, each said pair of said massaging means being mounted in said chamber for reciprocating movement relative to each other, and each said massaging means extending through a corresponding one of said at least one opening;

motor means for powering said massaging means being disposed in said power transmission chamber;

drive means disposed in said power transmission chamber for transmitting power from said motor means to said massaging means to move each pair of said massaging means between a relaxed position, in which said means are at a maximum separation distance relative to each other, and a pressing position, in which said means are relatively close together to each other; and said drive means including dwell means for periodically prolonging said massaging means in said pressing position so as to grab and hold the massaged flesh to simulate manual massage.

2. The kneader massager as defined in claim 1 further comprising track means in said chamber and secured to said housing for directing the reciprocating movement of said massaging means.

3. The kneader massager as defined in claim 2 wherein said massaging means includes at least one finger portion secured at one end to a base portion, said base portion configured to slidably engage said track means and having accommodating means for accommodating said drive means.

4. The kneader massager as defined in claim 3 wherein said accommodating means includes a cam follower formation on at least one of said base portions.

5. The kneader massager as defined in claim 1 wherein said motor includes a drive shaft with a worm gear.

6. The kneader massager as defined in claim 5 wherein said drive means includes at least one helical gear associated with a corresponding member of each of said at least one pairs of massaging means, each said at least one helical gear being configured to engage said worm gear.

7. The kneader massager as defined in claim 6 wherein each said at least one helical gear includes said dwell means in the form of an eccentric cam formation depending from a lower surface of said corresponding helical gear.

8. The kneader massager as defined in claim 7 wherein at least one of said eccentric cam formations is lobed in shape to prolong the disposition of said massaging means in said pressing position.

9. The kneader massager as defined in claim 8 wherein said lobed cam formations each have a generally teardrop shape when viewed from above.

10. The kneader massager as defined in claim 1 wherein said dwell means is configured to prolong the disposition of said massaging means in said pressing position through approximately 40 degrees of rotation.

11. The kneader massager as defined in claim 10 wherein said motor means is positioned relative to said drive means to rotate at a constant velocity while said dwell means prolongs the pressing position of said massaging means.

12. The kneader massager as defined in claim 1 wherein said massaging means includes a plurality of fingers, each provided with a resilient pad for contacting the skin of the user.

13. A kneader massager, comprising:

a housing having an upper portion and a lower portion, each said upper and lower portions defining a power transmission chamber having at least one opening;

at least one pair of massaging means for massaging the skin of a user, each said pair of said massaging means being mounted in said chamber for reciprocating movement relative to each other, and extending through said at least one opening;

motor means for powering said massaging means being disposed in said power transmission chamber;

drive means disposed in said power transmission chamber for transmitting power from said motor means to said massaging means to move each pair of said massaging means between a relaxed position, in which said means are at a maximum separation distance relative to each other, and a pressing position, in which said means are relatively close together to each other; and said drive means including dwell means for periodically prolonging the disposition of said massaging means in said pressing position so as to grab and hold the massaged flesh to simulate manual massage while said motor means rotates at a constant velocity.

14. The kneader massager as defined in claim 13 wherein said dwell means prolongs the disposition of said massaging means in said pressing position through approximately 40 degrees of rotation.

15. The kneader massager as defined in claim 13 wherein said massaging means includes resilient pads for contacting the skin of the user.

16. A kneader massager, comprising:

a housing having an upper portion and a lower portion, each said upper and lower portions defining a power transmission chamber having at least one opening, said housing also including a head portion and a stem portion, said stem portion being generally cylindrical in shape and extends from a side of said head portion;

at least one pair of massaging means for massaging the skin of a user, each said pair of said massaging means being mounted in said chamber at said head portion for reciprocating movement relative to each other, and extending through said at least one opening;

motor means for powering said massaging means being disposed in said power transmission chamber and principally located in said stem portion, said motor means including a drive shaft with a worm gear;

drive means disposed in said power transmission chamber at said head portion for transmitting power from said motor means to said massaging means to move each pair of said massaging means between a relaxed position, in which said means are at a maximum separation distance relative to each other, and a pressing position, in which said means are relatively close together to each other;

said drive means further including a pair of helical gears, one of said helical gears disposed in said transmission chamber on a corresponding side of said worm gear, and being associated with a corresponding member of each of said at least one pair of massaging means.

17. The kneader massager as defined in claim 16 wherein each said helical gear includes an eccentric cam formation depending from a lower surface of said corresponding helical gear for engaging a corresponding cam follower formation of said massaging means, said cam formation having a dwell portion.

* * * * *